US007971821B2

(12) United States Patent
Oelen et al.

(10) Patent No.: US 7,971,821 B2
(45) Date of Patent: Jul. 5, 2011

(54) DEVICE FOR APPLYING A PAPER WEB ONTO A PAPER REEL AND CORRESPONDING REEL CHANGER

(75) Inventors: Jan Oelen, Boxmeer (NL); Uilke Bosma, Montfoort (NL); Johannes Petrus Berkvens, Someren (NL)

(73) Assignee: Goss Contiweb B.V., Boxmeer (NL)

( * ) Notice: Subject to any disclaimer, the term of this patent is extended or adjusted under 35 U.S.C. 154(b) by 0 days.

(21) Appl. No.: 12/277,076

(22) Filed: Nov. 24, 2008

(65) Prior Publication Data

US 2009/0242686 A1 Oct. 1, 2009

(30) Foreign Application Priority Data

Nov. 23, 2007 (EP) ..... 07291394

(51) Int. Cl.
*B65H 19/18* (2006.01)

(52) U.S. Cl. ..... 242/555; 242/555.3; 242/555.5; 242/556.1

(58) Field of Classification Search ..... 242/555, 242/555.1–555.6, 556, 556.1
See application file for complete search history.

(56) References Cited

U.S. PATENT DOCUMENTS

| | | | | |
|---|---|---|---|---|
| 4,763,851 | A * | 8/1988 | Flament | 242/555.4 |
| 5,360,181 | A * | 11/1994 | Hayashi et al. | 242/555.6 |
| 5,709,355 | A * | 1/1998 | Kinnunen et al. | 242/555.3 |
| 6,241,179 | B1 * | 6/2001 | Hachiya et al. | 242/555.3 |
| 6,899,296 | B2 * | 5/2005 | Kansaku et al. | 242/555.5 |
| 7,156,340 | B2 * | 1/2007 | Shiraishi et al. | 242/555.5 |
| 2002/0148923 | A1 * | 10/2002 | Kiyota | 242/554 |

* cited by examiner

*Primary Examiner* — Sang Kim
(74) *Attorney, Agent, or Firm* — Davidson, Davidson & Kappel, LLC

(57) ABSTRACT

A device for applying a paper web onto a paper reel is provided, including a web application roller mobile between a guiding position of the paper web and an application position of the paper web onto the paper reel, and an actuator for moving the web application roller between its two positions. The device includes a locking mechanism adapted for locking the web application roller in its application position.
The device may be used in reel changers of web-fed offset printing presses.

9 Claims, 3 Drawing Sheets

DEVICE FOR APPLYING A PAPER WEB ONTO A PAPER REEL AND CORRESPONDING REEL CHANGER

This claims the benefit of European Patent Application No. 07291394.0, filed on Nov. 23, 2007 and hereby incorporated by reference herein.

The present invention relates to a device for applying a paper web onto a paper reel.

BACKGROUND

Web-fed offset printing presses comprise reel splicers that are used to splice the paper web of a new paper reel to the paper web of a paper reel currently in use. The reel spicers known in the art comprise a splicehead having a frame onto which a web application roller is articulated by a lever between a first position, in which the current web is guided, and a second position, in which the current web is pressed against the new paper reel. The lever has two branches, one carrying the web application roller and one articulated directly to a pneumatic cylinder. The pneumatic cylinder is used to move the web application roller between its two positions.

Due to the direct coupling of the web application roller to the pneumatic cylinder, the web application roller bounces off the paper reel in case it is applied too fast on the paper reel. Consequently, the new paper web and the old paper web are not spliced correctly.

BRIEF SUMMARY OF THE INVENTION

The present invention provides a splicehead for correct splicing of the two paper webs.

To this end an object of the present invention provides a device for applying a paper web onto a paper reel, including a web application roller mobile between a guiding position of the paper web and an application position of the paper web onto the paper reel, and an actuator for moving the web application roller between its two positions including a locking mechanism adapted for locking the web application roller in its application position.

According to different embodiments, the device according to the invention may have the following features:

- a frame and that the web application roller is mobile between its guiding and application positions with respect to the frame;
- the web application roller is articulated to the frame between its guiding and application positions;
- the web application roller is linked to the frame by a first lever around a first axis;
- the locking mechanism includes a second lever linked to the frame around a second axis and linked to the actuator, in that it includes a third lever linked to the web application roller around a third axis and linked to the actuator, and in that the second and third levers are linked to the actuator around a common fourth axis;
- the locking mechanism defines a dead center, and, when the web application roller is between its application position and a position corresponding to the dead center, the locking mechanism is adapted to create a force directed to the application position in reaction to a force applied from the paper reel to the web application roller;
- the fourth axis defines the dead center with respect to the frame and the position of the fourth axis is on opposite sides of the dead center when the web application roller is its application and guiding positions;

- the actuator is adapted to move the web application roller over a predetermined distance between its guiding and application positions; and
- the actuator includes a pneumatic cylinder.

The invention also provides a reel changer adapted for being used in a web-fed printing press, including a support for at least two paper reels and having a device according to the present invention.

BRIEF DESCRIPTION OF THE DRAWINGS

The invention will be best understood in light of the following description of a specific, non-limiting embodiment of the invention. The description refers to the annexed drawings, which show:

On FIG. 1 a schematic side view of a reel changer according to the invention, On FIG. 2 an enlarged view of a part of the reel changer of FIG. 1 in its web guiding configuration, and On FIG. 3 the enlarged view of FIG. 2, the reel changer being in its application configuration.

DETAILED DESCRIPTION

Figure 1:
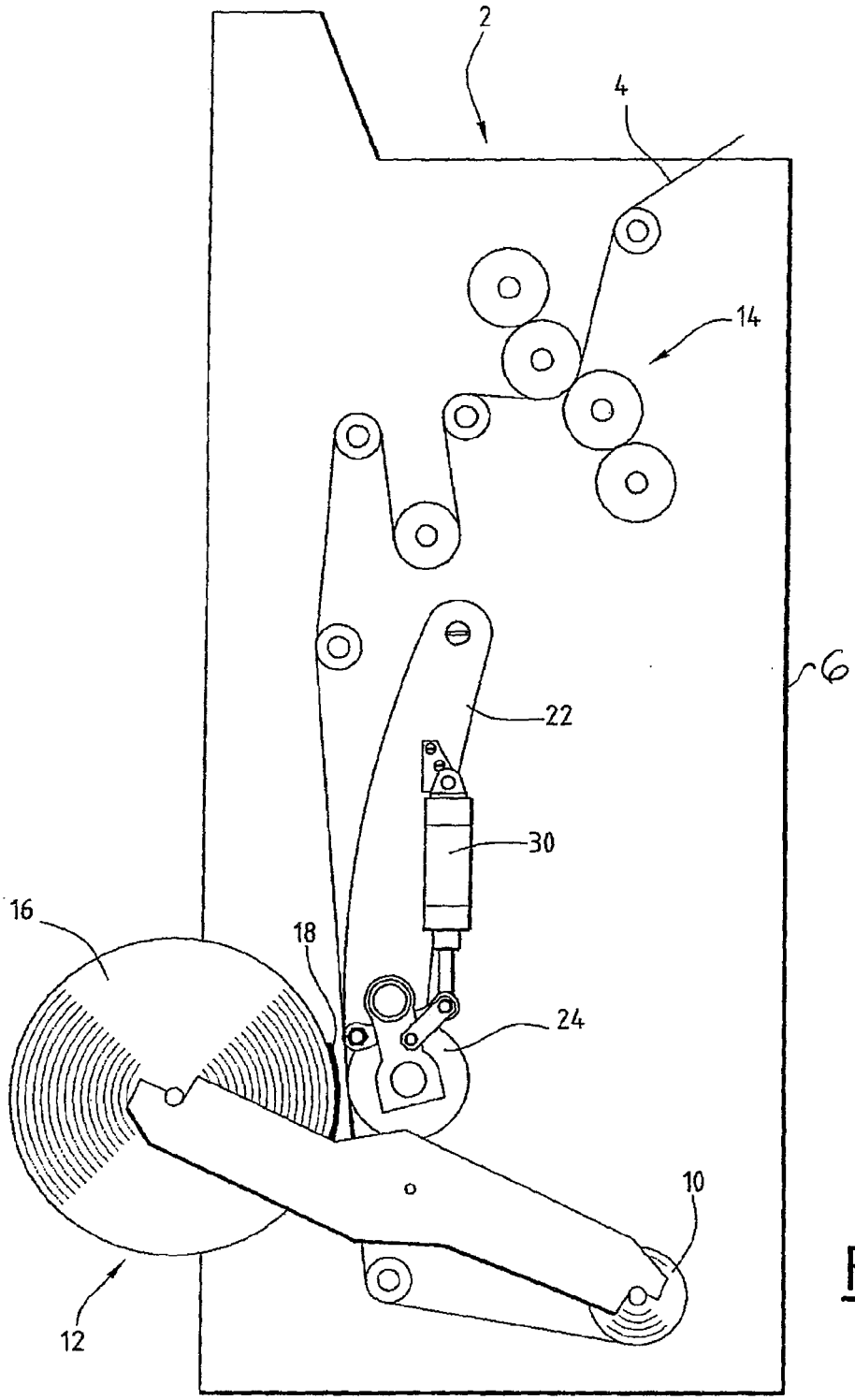

FIG. 1 shows a reel changer of a web-fed offset printing press. The reel changer is designated by the general reference 2 and is also called splicer. The press includes printing units that are fed by a current paper web 4. The reel changer includes a frame 6 of which one side plate is visible. The reel changer 2 includes also a carrier 8 for carrying a current paper reel 10 and a new paper reel 12.

The reel changer 2 has a plurality of guide rollers 14 for guiding the current paper web 4.

The new paper reel 12 includes a new paper web 16 and an adhesive front part 18 for splicing the new paper web 16 to the current paper web 4.

The current paper web 4 is reeled off the current paper reel 10, runs through the plurality of guide rollers 14 and toward the print units of the press.

The reel changer 2 includes also a device 20 for applying the current paper web 4 onto the new paper reel 12, more precisely to the adhesive front part 18.

Figure 2:
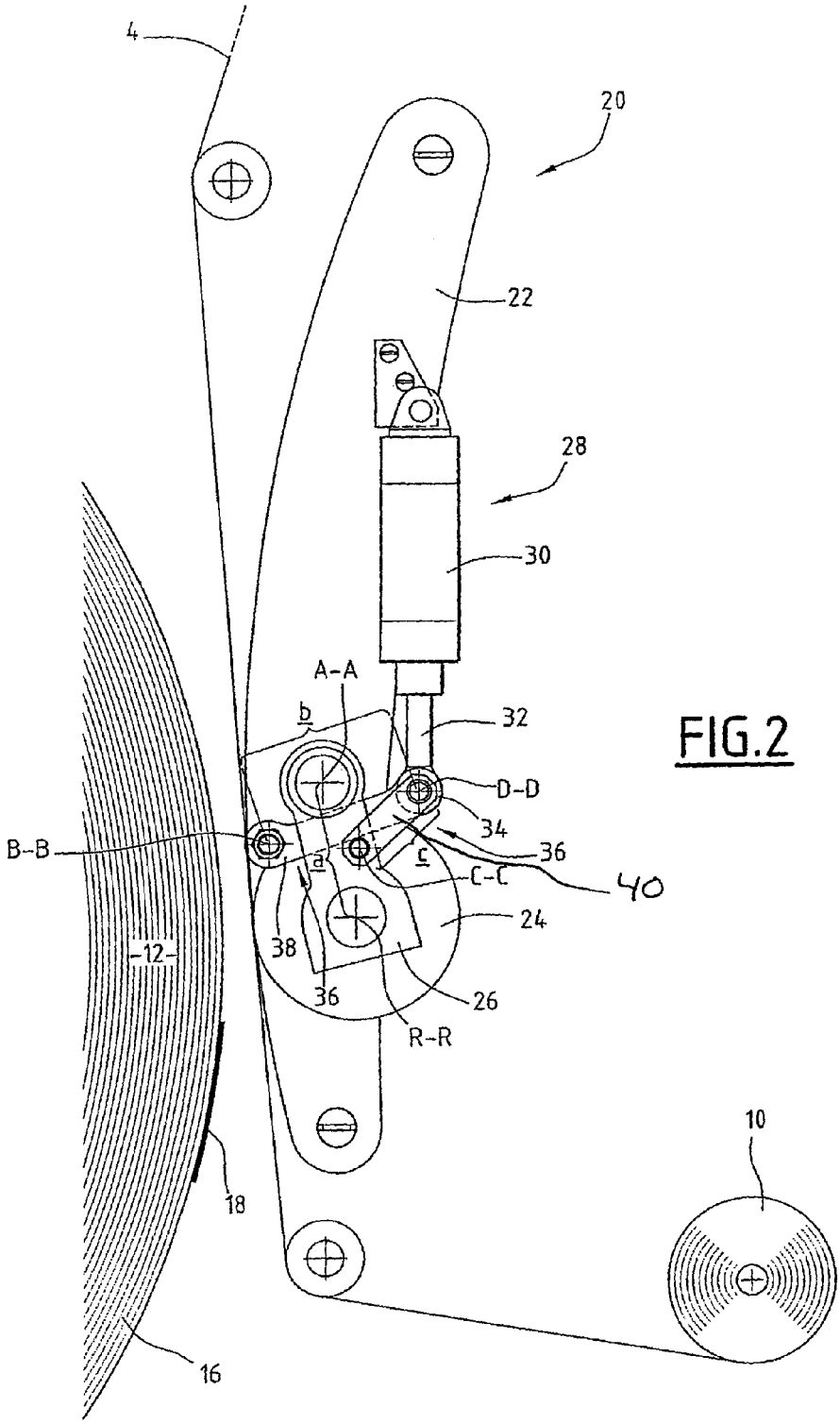
Figure 3:
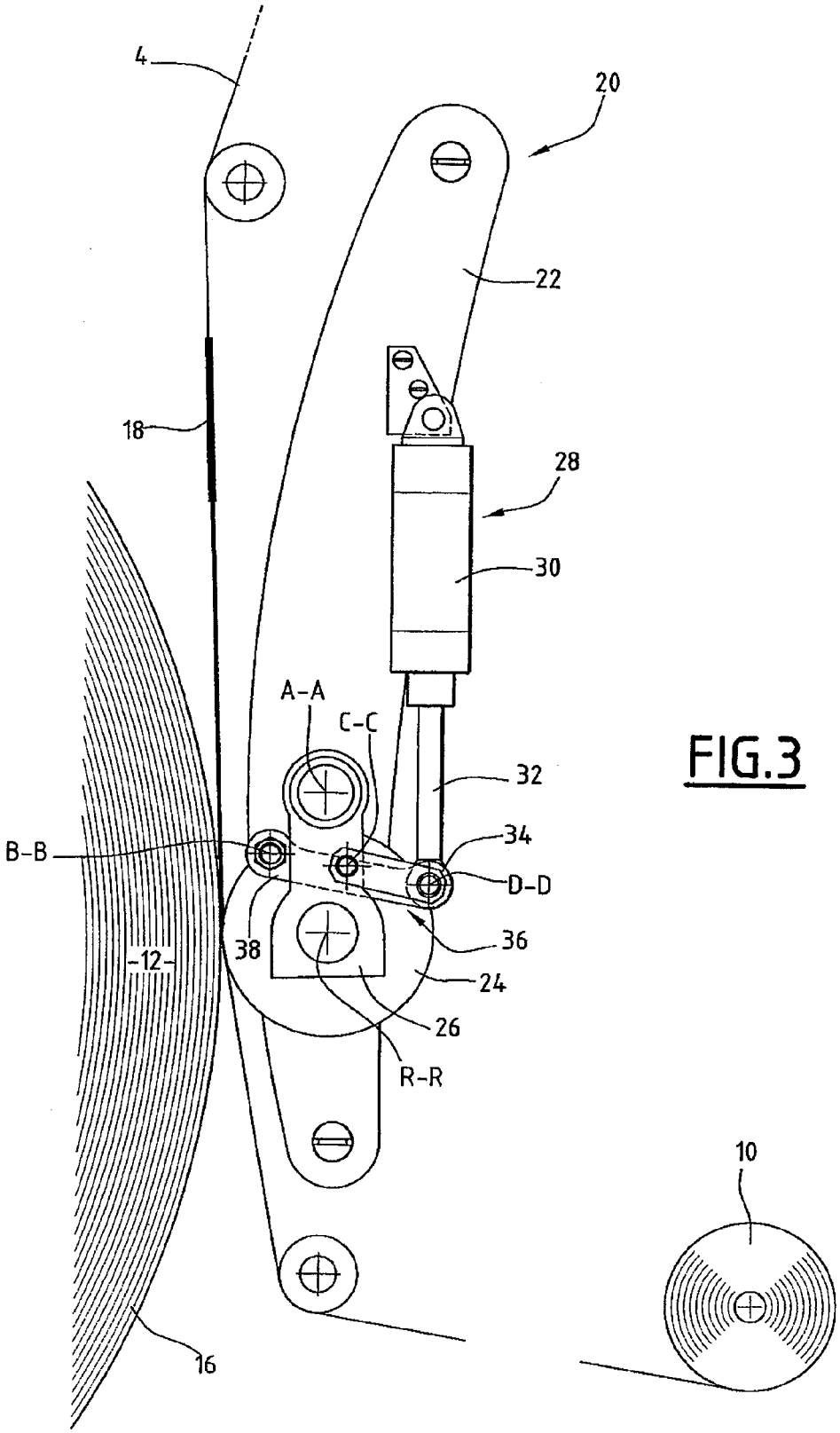

The device 20 for applying the current paper web 4 to the new paper reel 12 is represented in detail in FIGS. 2 and 3.

The device 20 includes a frame plate 22 fixed to frame 6. The device 20 has also a web application roller 24 articulated about a first axis A-A to the frame plate 22 via a first lever 26. The first lever 26 has a first lever arm designated a, which is the distance between the first axis A-A and a rotation axis R-R of web application roller 24. The web application roller 24 is movable about first axis A-A between a web guiding position, represented on FIG. 2, and an application position, represented on FIG. 3. In the web guiding position, the web application roller 24 guides the current paper web 4 from the current reel 10 to the plurality of rollers 14, the current paper web 4 being at a distance from the new paper reel 12. In the application position, the web application roller 24 applies the current paper web 4 onto the new paper reel 12.

The device 20 includes also an actuator 28 adapted for moving the web application roller 24 between the guiding position and the application position. In the present embodiment, the actuator 28 is a pneumatic cylinder. The actuator 28 has a housing 30 connected to the frame plate 22 and a piston rod 32 having a head 34.

The device 20 includes also a locking mechanism 36 adapted to lock the web application roller 24 in its application position so that a reaction force generated by the application of the web application roller 24 on the paper reel 12 does not move the web application roller 24 towards its guiding position.

To this end, the locking mechanism 36 includes a second lever 38 linked to the frame plate 22 around a second axis B-B and linked to the head 34 around a common fourth link axis D-D. The second lever 38 has a lever arm designated b and measured from second axis B-B to the common fourth link axis D-D of head 34.

The locking mechanism 36 comprises also a third lever 40 linked to the first lever 26 around a third axis C-C and linked to the head 34 around common fourth link axis D-D. The third lever 40 has a lever arm c measured between third axis C-C and common link axis D-D.

The first lever arm a is smaller than second lever arm b, and the third lever arm c is smaller than second lever arm b.

The locking mechanism 36 defines a dead center DC for the fourth link axis D-D, which in the present embodiment is the position in which the planes of the second lever 38 and the third lever 40 are aligned with each other. These planes are defined for second lever 38 by second link axis B-B and fourth link axis D-D and for the third lever 40 by third link axis C-C and fourth link axis D-D.

When the web application roller 24 is in a position between the application position and the position corresponding to the dead center DC of the fourth link axis D-D, a reaction force of new paper reel 12 to the web application roller 24 tends to push web application roller 24 towards its application position. The locking mechanism 36 is therefore auto locking as soon as the dead center DC has been passed by common link axis D-D.

As can be seen from the Figures, the fourth link axis D-D is situated on opposite sides of the dead center DC when the web application roller 24 is in its guiding position and its application position.

The actuator 28 is adapted to move the web application roller 24 over a predetermined distance from its web guiding position to its application position.

The reel changer 2 according to the invention works in the following manner.

In the initial position, the current paper web 4 is reeled off current paper reel 10 and runs over web guiding roller 24 to the plurality of rollers 14. The web guiding roller 24 is in its guiding position. The new paper reel 12 is loaded onto the carrier 8 and is rotatably driven around its own axis.

Just before the current paper reel 10 runs out, the actuator 28 is actuated and the head 34 moves into its extended position. This movement pushes the web application roller 24 around first axis A-A, in the clockwise direction on the Figures, into its application position. The web application roller 24 applies therefore current paper web 4 to the new paper reel 12 and when the adhesive front part 18 contacts the current web 4, it sticks to the current web 4.

From this moment on, the new paper web 16 is reeled off the new paper reel 12 (see FIG. 3).

Subsequently, the current paper web 4 is cut by a cutting mechanism and the current paper reel 10, which is now a residual paper reel, is taken off the carrier 8.

The locking mechanism having two levers 26 and 38 may be particularly simple to manufacture and assemble.

Also the use of two levers 26, 38 for automatically locking the web application roller 24 may be simple and uses little energy. In a variant of the device according to the invention, other locking mechanisms could be used to lock the web applicator roller in its application position.

What is claimed is:

1. A device for applying a paper web onto a paper reel comprising:

a web application roller mobile between a guiding position of the paper web and an application position of the paper web onto the paper reel;

an actuator for moving the web application roller between the guiding position and the application position; and a locking mechanism for locking the web application roller in the application position, the locking mechanism including a second lever linked to a frame around a second axis and a third lever linked to the web application roller around a third axis, the second lever and third levers being linked to each other at a common fourth axis, the locking mechanism defining a dead center, the dead center being a configuration of the second and third levers in which the second axis, third axis and fourth axis are in a common dead center plane, and when the web application roller is between the application position and a position corresponding to the dead center, the second and third levers create a force directed to the application position in reaction to a force applied from the paper reel to the web application roller.

2. The device as recited in claim 1 further comprising a frame, the web application roller being mobile between the guiding position and the application position with respect to the frame.

3. The device as recited in claim 2 wherein the web application roller is articulated to the frame between the guiding position and the application position.

4. The device as recited in claim 3 wherein the web application roller is linked to the frame by a first lever around a first axis.

5. The device as recited in claim 2 wherein the second lever linked is linked to the actuator and the third lever is linked to the actuator, the second lever and third lever being linked to the actuator around a common fourth axis.

6. The device as recited in claim 5 wherein the locking mechanism defines a dead center, when the web application roller is between the application position and a position corresponding to the dead center, the locking mechanism is adapted to create a force directed to the application position in reaction to a force applied from the paper reel to the web application roller, a position of the common fourth axis being on opposite sides of the dead center when the web application roller is in the application position and when the web application roller is in the guiding position.

7. The device as recited in claim 1 wherein the actuator is adapted to move the web application roller over a predetermined distance between the guiding position and the application position.

8. The device as recited in claim 1 wherein the actuator includes a pneumatic cylinder.

9. A reel changer adapted for use in a web-fed printing press comprising:

a support for at least two paper reels; and a device for applying a paper web onto a paper reel, the device including:

a web application roller mobile between a guiding position of the paper web and an application position of the paper web onto the paper reel;

an actuator for moving the web application roller between the guiding position and the application position; and a locking mechanism for locking the web application roller in the application position, the locking mechanism including a second lever linked to a frame around a second axis and a third lever linked to the web application roller around a third axis, the second lever and third levers being linked to each other at a common fourth axis, the locking mechanism defining a dead center, the dead center being a configuration of the second and third levers in which the second axis, third axis and fourth axis are in a common dead center plane, and when the web application roller is between the application position and a position corresponding to the dead center, the second and third levers create a force directed to the application position in reaction to a force applied from the paper reel to the web application roller.

* * * * *